US011056797B2

(12) United States Patent
Rommel et al.

(10) Patent No.: US 11,056,797 B2
(45) Date of Patent: Jul. 6, 2021

(54) ARTICLES COMPRISING A MESH FORMED OF A CARBON NANOTUBE YARN

(71) Applicant: Eagle Technology, LLC, Melbourne, FL (US)

(72) Inventors: Monica Rommel, Savage, MN (US); Rodney Sorrell, Melbourne, FL (US); David Norton, Rockledge, FL (US); Maria R. Parkhurst, Melbourne, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 100 days.

(21) Appl. No.: 16/524,698

(22) Filed: Jul. 29, 2019

(65) Prior Publication Data

US 2021/0036429 A1 Feb. 4, 2021

(51) Int. Cl.

| | |
|---|---|
| ***H01Q 15/16*** | (2006.01) |
| ***D04B 1/14*** | (2006.01) |
| ***D04B 21/12*** | (2006.01) |

(52) U.S. Cl.

CPC ..... *H01Q 15/16* (2013.01); *D04B 1/14* (2013.01); *D04B 21/12* (2013.01); *H01Q 15/168* (2013.01); *D10B 2101/122* (2013.01)

(58) Field of Classification Search

CPC ..... H01Q 15/16; H01Q 15/168; D04B 21/12; D04B 1/14

See application file for complete search history.

(56) References Cited

U.S. PATENT DOCUMENTS

| | | | | |
|---|---|---|---|---|
| 4,609,923 | A | 9/1986 | Boan et al. | |
| 4,812,854 | A | 3/1989 | Boan et al. | |
| 6,590,231 | B2 | 7/2003 | Watanabe et al. | |
| 6,901,249 | B1 | 5/2005 | Kobayashi | |
| 7,354,877 | B2 | 4/2008 | Rosenberger et al. | |
| 7,714,798 | B2 | 5/2010 | Lashmore et al. | |
| 7,734,271 | B2 | 6/2010 | Pepper et al. | |
| 8,548,415 | B2 | 10/2013 | Pesetski et al. | |
| 8,654,033 | B2 * | 2/2014 | Sorrell | H01Q 15/14 343/897 |
| 8,926,933 | B2 | 1/2015 | Zhang et al. | |

(Continued)

FOREIGN PATENT DOCUMENTS

| | | | |
|---|---|---|---|
| EP | 0917283 | A2 | 5/1999 |
| WO | 2001003208 | A1 | 1/2001 |
| WO | 2004030043 | A2 | 4/2004 |

OTHER PUBLICATIONS

J. Beigbeder, P. Demont, S. Remaury, P. Nabarra and C. Lacabanne , Incorporation of Nanoparticles in a Flexible Solar Reflector for Geostationary Applications, International Symposium on Materials in a Space Environment, 2009 (Year: 2009).*

(Continued)

*Primary Examiner* — Graham P Smith
*Assistant Examiner* — Jae K Kim
(74) *Attorney, Agent, or Firm* — Fox Rothschild LLP; Robert J. Sacco; Carol E. Thorstad-Forsyth

(57) ABSTRACT

An antenna reflector comprising a mesh material formed of a Carbon Nano-Tube ("CNT") yarn that is reflective of radio waves and has a low solar absorptivity to hemispherical emissivity ratio ($\alpha_{solar}/\varepsilon_H$ ratio) and a low Coefficient of Thermal Expansion ("CTE").

6 Claims, 2 Drawing Sheets

(56) References Cited

U.S. PATENT DOCUMENTS

| | | | | |
|---|---|---|---|---|
| 9,276,305 | B2 * | 3/2016 | Keller | H01Q 1/273 |
| 9,318,808 | B1 * | 4/2016 | Weaver | H01Q 15/148 |
| 9,810,820 | B1 | 11/2017 | Starkovich et al. | |
| 10,447,178 | B1 * | 10/2019 | Hays | D03D 1/0088 |
| 2001/0023968 | A1 | 9/2001 | Smith et al. | |
| 2002/0014999 | A1 | 2/2002 | Crowley | |
| 2004/0023576 | A1 * | 2/2004 | Rock | D04B 1/14 442/59 |
| 2005/0056877 | A1 | 3/2005 | Rueckes et al. | |
| 2005/0095938 | A1 * | 5/2005 | Rosenberger | A41D 31/265 442/194 |
| 2005/0282515 | A1 | 12/2005 | Bertin | |
| 2006/0261433 | A1 | 11/2006 | Manohara et al. | |
| 2006/0270301 | A1 * | 11/2006 | Marks | H01Q 15/141 442/316 |
| 2007/0281657 | A1 | 12/2007 | Brommer et al. | |
| 2010/0086729 | A1 * | 4/2010 | Long | B32B 7/12 428/116 |
| 2010/0258111 | A1 * | 10/2010 | Shah | C23C 28/322 126/635 |
| 2011/0097512 | A1 * | 4/2011 | Zhou | H01B 1/04 427/545 |
| 2016/0376747 | A1 * | 12/2016 | Wang | D03D 15/00 428/335 |
| 2017/0120220 | A1 * | 5/2017 | Watanabe | B01J 21/18 |
| 2017/0274390 | A1 * | 9/2017 | Manyapu | B08B 17/02 |
| 2020/0362236 | A1 * | 11/2020 | Cui | H02S 10/30 |

OTHER PUBLICATIONS

Andreas Ericsson, Romain Rumpier, Daniel Sjöberg, Peter Göransson, Niklas Wellander, Joakim Johansson, A combined electromagnetic and acoustic analysis of a triaxial carbon fiber weave for reflector antenna applications, Aerospace Science and Technology, vol. 58, Nov. 2016, pp. 401-417 (Year: 2016).*

Shirasu, Keiichi & Yamamoto, Go & Tamaki, Itaru & Ogasawara, Toshio & Shimamura, Yoshinobu & Inoue, Yoku & Hashida, Toshiyuki. (2015). Negative axial thermal expansion coefficient of carbon nanotubes: Experimental determination based on measurements of coefficient of thermal expansion for aligned carbon nanotube reinforced epoxy composites. Carbon. 95. 904-909. 10.1016/j.carbon.2015.09.026.

G. Hidden, L. Boudou, S. Remaury, P. Nabarra, E. Flahaut and J. M. Vega, "Development of CNT-polysiloxane composites for spacecraft applications," Proceedings of the 2004 IEEE International Conference on Solid Dielectrics, 2004. ICSD 2004., Toulouse, France, 2004, pp. 955-958 vol. 2, doi: 10.1109/ICSD.2004.1350590.

European Search Report issued in EP 20186379 dated Nov. 25, 2020.

High Frequency Reflective Mesh for Small Aperture Antennas, SPIR Award, Tracking No. 156678, funding solicited in 2016, awarded in 2017 https://www.sbir.gov/sbirsearch/detail/1425893.

Nanocomp Technologies, Inc. A Huntsman Company, Miralon Yarn, http://www.miralon.com/yarn, copyright 2016 Nanocomp Technologies Inc.

* cited by examiner

ARTICLES COMPRISING A MESH FORMED OF A CARBON NANOTUBE YARN

STATEMENT REGARDING FEDERAL FUNDING

The invention was made with government support under contract number 16-C-0027. The government has certain rights in the invention.

BACKGROUND

Statement of the Technical Field

The present disclosure relates generally to mesh articles (e.g., an antenna). More particularly, the present disclosure relates to articles comprising a mesh formed of a Carbon Nano-Tube ("CNT") yarn.

Description of the Related Art

Satellites require Radio Frequency ("RF") energy concentrating antennas to provide high gain. These antennas comprise precision parabolic or similar shaped antenna reflectors that are carried into space using launch vehicles. The antenna reflectors may be formed of knitted mesh materials. One such knitted mesh material comprises a gold plated tungsten wire (e.g., such as that disclosed in U.S. Pat. No. 4,609,923) or a gold plated molybdenum wire. These gold plated wire mesh materials have two inherent deficiencies for antenna applications. First, the gold plated wire has a high solar absorptivity to hemispherical emissivity ratio (e.g., $\alpha_{solar}/\varepsilon_H=8$) which results in high mesh temperatures. Secondly, the gold plated wire has a relatively high Coefficient of Thermal Expansion ("CTE") (e.g., approximately 4.5 ppm/C° for the tungsten wire and approximately 5.0 ppm/C° for the molybdenum wire). The high $\alpha_{solar}/\varepsilon_H$ ratio in conjunction with the high CTE results in thermal distortion of the antenna reflector due to on-orbit temperatures. This thermal distortion degrades antenna performance, for example, by reducing gain and increasing sidelobe levels.

SUMMARY

The present disclosure concerns an antenna reflector. The antenna reflector comprises a mesh material formed of a Carbon Nano-Tube ("CNT") yarn that is reflective of radio waves and has a low $\alpha_{solar}/\varepsilon_H$ ratio and a low CTE. The mesh material has an areal density that is less than ten percent of an areal density of a mesh material formed using a gold plated tungsten or molybdenum wire with a diameter equal to the diameter of the CNT yarn.

In some scenarios, the low $\alpha_{solar}/\varepsilon_H$ ratio is less than 25% of the $\alpha_{solar}/\varepsilon_H$ ratio of a gold plated tungsten or molybdenum wire. In some scenarios, the low CTE is more than an order of magnitude less than a CTE of gold plated tungsten or molybdenum wire. For example, the low CTE is equal to −0.3 ppm/C°. In those or other scenarios, the mesh material is a knitted mesh material. The knitted mesh material may have a tricot configuration and/or have 10-100 openings per inch.

BRIEF DESCRIPTION OF THE DRAWINGS

The present solution will be described with reference to the following drawing figures, in which like numerals represent like items throughout the figures.

DETAILED DESCRIPTION

Figure 1:
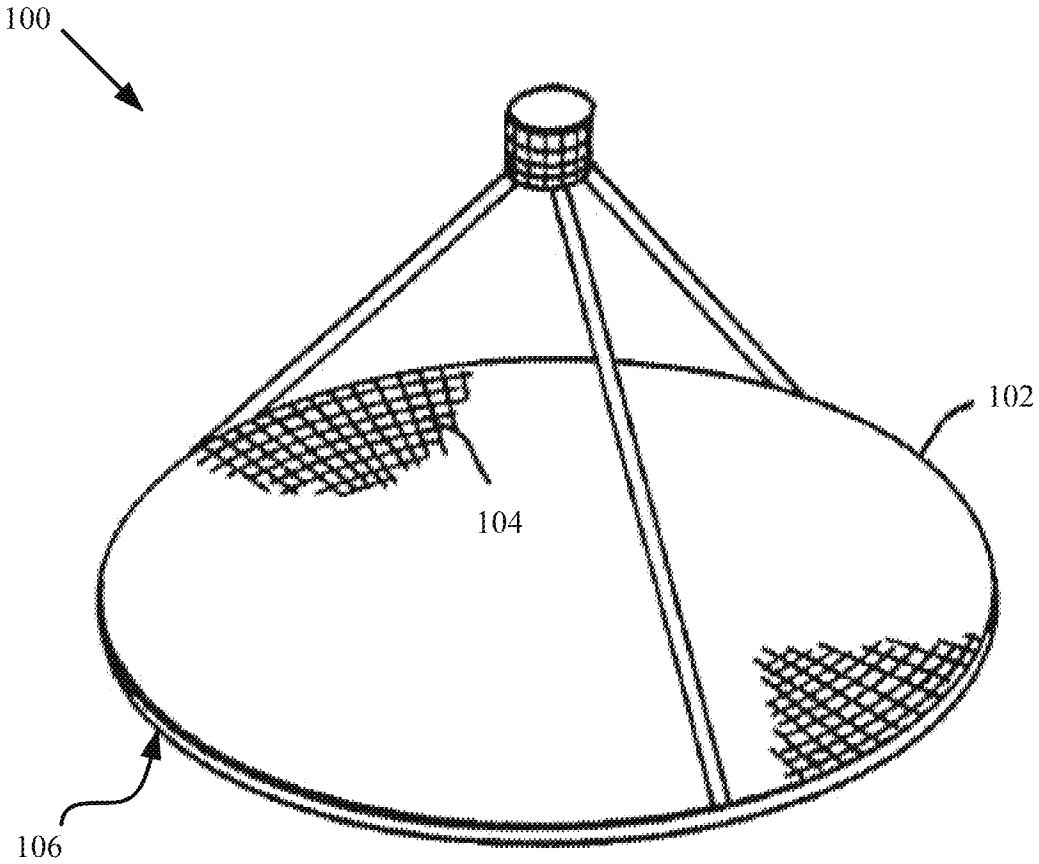
FIG. 1 is a perspective view of an illustrative mesh antenna.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution concerns articles comprising a mesh formed of a CNT yarn. The present solution is described herein in relation to antenna applications. The present solution is not limited in this regard. The CNT yarn disclosed herein can be used in other applications in which a mesh with a low $\alpha_{solar}/\varepsilon_H$ ratio and/or a low CTE is needed.

One type of wire used for mesh antennas is a gold plated molybdenum wire (as noted above in the Background section of this paper). The gold plated molybdenum wire has the following properties: a small diameter (e.g., 0.5-1.2 mil); a high solar absorptivity to hemispherical emissivity ratio (e.g., $\alpha_{solar}/\varepsilon_H$=8); and a high CTE (e.g., 5.0 ppm/C°). The mesh produced with gold plated molybdenum wire has an acceptable stiffness and areal density. A real density refers to the mass of the mesh per unit area. The areal density of the mesh material is a function of wire diameter, knit type configuration, and/or openings per inch.

Despite the benefits of mesh antennas incorporating gold plated tungsten or molybdenum wire, these mesh antennas suffer from certain drawbacks. First, the gold plated wire has a high solar absorptivity to hemispherical emissivity ratio (e.g., $\alpha_{solar}/\varepsilon_H$=8) which results in high mesh temperatures. Secondly, the gold plated wire has a relatively high CTE (e.g., approximately 4.5 ppm/C° for the tungsten wire and approximately 5.0 ppm/C° for the molybdenum wire). The high $\alpha_{solar}/\varepsilon_H$ ratio in conjunction with the high CTE results in thermal distortion of the antenna reflector due to on-orbit temperatures.

Accordingly, the mesh antennas of the present solution are formed from a CNT yarn rather than from a gold plated tungsten or molybdenum wire. The CNT yarn has the following properties: a small diameter (e.g., 0.5-1.2 mil); a low solar absorptivity to hemispherical emissivity ratio ($\alpha_{solar}/\varepsilon_H$=2); and a low CTE (e.g., −0.3 ppm/C°). The $\alpha_{solar}/\varepsilon_H$ ratio and low CTE of the CNT yarn allows for antenna reflectors with enhanced performance and higher operational frequency capabilities. The low $\alpha_{solar}/\varepsilon_H$ ratio reduces the thermal distortion experienced by the mesh reflector surface compared to that experienced in conventional mesh reflectors formed of gold plated tungsten or molybdenum wire by reducing mesh temperatures. The low CTE also reduces the thermal distortion experienced by the mesh reflector surface compared to that experienced in conventional mesh reflectors formed of gold plated tungsten or molybdenum wire. The knittability of the CNT yarn allows for a relatively wide range of possible openings per inch (e.g., 10-100 openings per inch) in a knitted material. Additionally, the CNT yarn provides mesh materials with areal densities that are less than ten percent of the areal density of a mesh material formed using the gold plated tungsten or molybdenum wire with a diameter equal to the diameter of the CNT yarn.

Notably, the ability to create a usable mesh from a CNT yarn for antenna applications has not been achievable in the past. However, with the creation of a new CNT yarn described herein, a mesh that is usable for antenna applications is now achievable. The new CNT yarn is applicable to any mesh antenna. This includes antennas with unfurlable mesh reflectors (i.e., a deployable reflector that transitions from a closed position to an open position) and fixed mesh reflectors (i.e., an antenna reflector that does not deploy).

Illustrative Antenna

Figure 3:
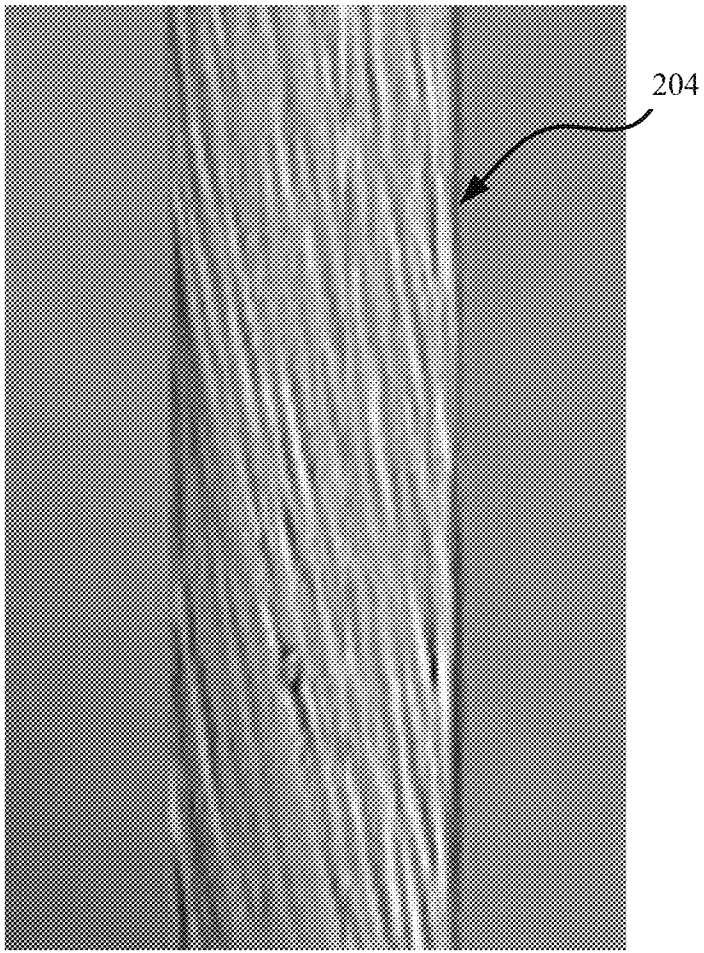
FIG. 3 shows an image of a strand of CNT yarn.

Referring now to FIG. 1, there is provided an illustration of an illustrative mesh antenna 100 for radiating a narrow beam of radio waves for point-to-point communications in satellite dishes. The mesh antenna 100 has a CNT yarn incorporated therein. The CNT yarn includes, but is not limited to, a Miraion® yarn available from Nanocomp Technologies, Inc. of Merrimack, N.H. An image of the CNT yarn is provided in FIG. 3. The CNT yarn is strong, lightweight, and flexible. The CNT yarn has a low solar absorptivity to hemispherical emissivity ratio (e.g., $\alpha_{solar}/\varepsilon_H$=2). In some scenarios, the low $\alpha_{solar}/\varepsilon_H$ ratio is less than 25% of the $\alpha_{solar}/\varepsilon_H$ ratio of a gold plated tungsten or molybdenum wire. The CNT yarn also has a low CTE that is more than an order of magnitude less than a CTE of a gold plated tungsten or molybdenum wire. For example, the CNT yarn has a CTE equal to −0.3 ppm/C°. All of these features of the CNT yarn are desirable in antenna applications and/or space based applications.

As shown in FIG. 1, the mesh antenna 100 comprises an antenna reflector 102 configured to reflect Electro-Magnetic ("EM") energy in the radio wave band of the EM spectrum. The antenna reflector 102 is shown as comprising a fixed mesh reflector (i.e., an antenna reflector that does not deploy). The present solution is not limited in this regard. The antenna reflector 102 can alternatively comprise an unfurlable mesh reflector (i.e., a deployable reflector that transitions from a closed position to an open position). In both cases, a mechanical support structure is provided for the mesh. Such mechanical support structures are well known in the art, and therefore will not be described herein. For example, in a fixed mesh reflector scenario, the mechanical support structure comprises a hoop or ring 106 formed of a rigid or semi-rigid material (e.g., graphite composite, metal or plastic). In contrast, in an unfurlable mesh reflector scenario, the mechanical support structure typically comprises either radial or perimeter structural elements. A cord network may also be provided to assist in shaping the reflector surface and keeping the mesh taut during operation of the antenna 100.

The antenna reflector 102 is formed of a knitted mesh material, has a generally parabolic shape, and has a relatively high directivity. The knitted mesh material includes, but is not limited to, a single layer of mesh. The knitted mesh material comprises a series of interlocking loops 104 formed from the CNT yarn. The knitted mesh material has a number of openings per inch selected based on the frequency of the EM energy to be reflected by the mesh antenna 100 (e.g., 10-100 openings per inch). The parabolic shape focuses a beam signal into one point.

The present solution is not limited to knitted mesh materials. In other applications, the mesh material is a weave material rather than a knitted material. The weave material comprises a first set of filaments intertwined with a second set of filaments. Interstitial spaces or openings may be provided between the filaments.

Figure 2:
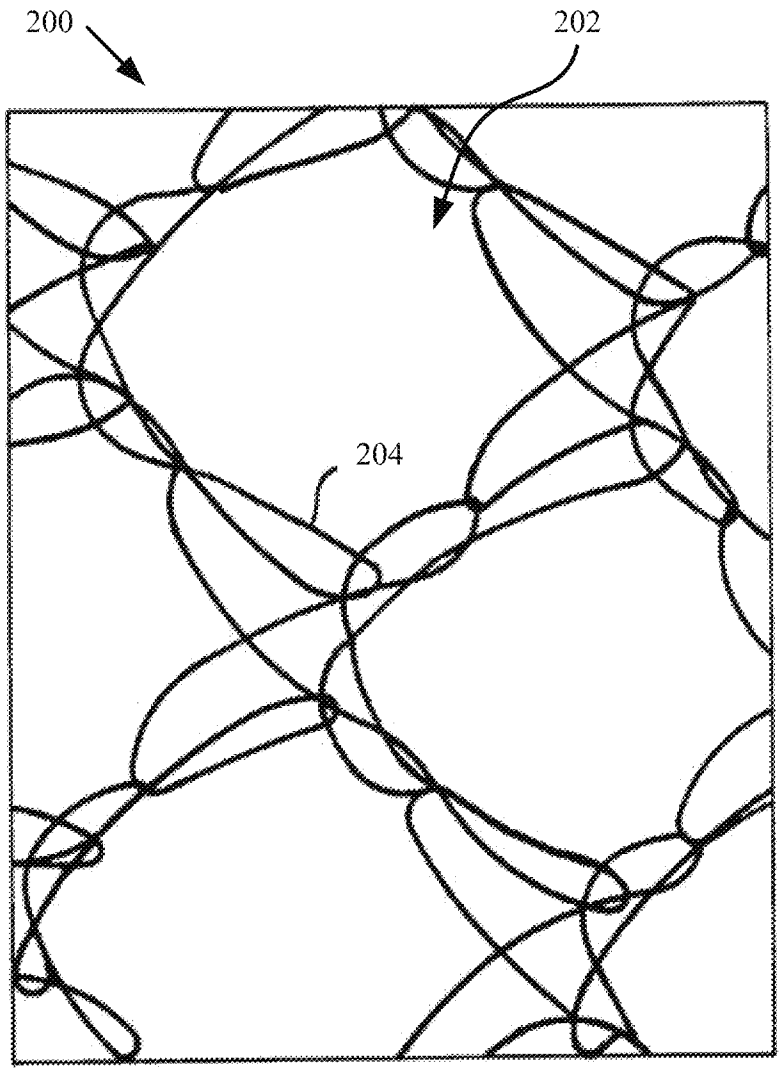
FIG. 2 is an illustration of an illustrative mesh knit in which a CNT yarn material is incorporated.

In some scenarios, the knitted mesh material of the antenna reflector 102 comprises a tricot type knit configuration as shown in FIG. 2. The present solution is not limited in this regard. Other types of knit configurations can be used herein instead of the tricot knit configuration. The tricot type knitted material 200 has an opening count of 10-100 per inch. Each opening 202 is defined by multiple loops of CNT yarn 204. The tricot type knitted material 200 has an areal density that is less than ten percent of an areal density of a tricot type knitted mesh material formed using a gold plated tungsten or molybdenum wire with a diameter equal to the diameter of the CNT yarn.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. An antenna reflector, comprising:

a mesh material formed of a Carbon Nano-Tube ("CNT") yarn that (i) comprises a plurality of carbon nano-tubes, (ii) is reflective of radio waves, (iii) has a solar absorptivity to hemispherical emissivity ratio ($\alpha_{solar}/\varepsilon_H$ ratio) that is equal to or less than 2, and (iv) has a Coefficient of Thermal Expansion ("CTE") that is equal to zero plus or minus 0.5 ppm/C°.

2. The antenna reflector according to claim 1, wherein the mesh material is a single or multiple layer mesh material.

3. The antenna reflector according to claim 1, wherein the mesh material is a knitted mesh material.

4. The antenna reflector according to claim 3, wherein the knitted mesh material has a tricot configuration.

5. The antenna reflector according to claim 3, wherein the knitted material has 10-100 openings per inch.

6. The antenna reflector according to claim 1, wherein the mesh material has an areal density that is less than ten percent of an areal density of a mesh material formed using the gold plated tungsten or molybdenum wire with a diameter equal to the diameter of the CNT yarn.

* * * * *